US007168988B1

(12) United States Patent
Rothermel

(10) Patent No.: US 7,168,988 B1
(45) Date of Patent: Jan. 30, 2007

(54) POWER CONNECTOR WITH INTEGRATED DECOUPLING

(75) Inventor: Brent Ryan Rothermel, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/190,746

(22) Filed: Jul. 27, 2005

(51) Int. Cl.
*H01R 13/648* (2006.01)
*H01R 4/66* (2006.01)

(52) U.S. Cl. ..... 439/608; 439/108

(58) Field of Classification Search ..... 439/608, 439/607, 79, 108, 941
See application file for complete search history.

(56) References Cited

U.S. PATENT DOCUMENTS 6,808,399 B2 * 10/2004 Rothermel et al. ..... 439/108
6,824,391 B2 * 11/2004 Mickievicz et al. ..... 439/61
2003/0220020 A1 * 11/2003 Billman ..... 439/608
2005/0032430 A1 * 2/2005 Otsu et al. ..... 439/608
2005/0118869 A1 * 6/2005 Evans ..... 439/608
2006/0014433 A1 * 1/2006 Consoli et al. ..... 439/608
2006/0046568 A1 * 3/2006 Consoli et al. ..... 439/608

* cited by examiner

*Primary Examiner*—Hien Vu

(57) ABSTRACT

A power connector includes a housing and an electrical wafer mounted in the housing. The wafer includes a dielectric material having a thickness between a first side and a second side. The second side is opposite the first side and substantially parallel to the first side. A power trace is located on the first side of the wafer. A ground trace is located on the second side of the wafer. The power trace at least partially overlaps the ground trace. The thickness is such that the power trace and the ground trace form a decoupling capacitor that reduces fluctuations in the power transmitted through the connector.

18 Claims, 5 Drawing Sheets

POWER CONNECTOR WITH INTEGRATED DECOUPLING

BACKGROUND OF THE INVENTION

The invention relates generally to electrical connectors and, more particularly, to a power connector that reduces fluctuations in transmitted power.

In some power distribution systems, power is distributed from a central power supply or power source connected to a backplane and then distributed from a power plane to a daughter board through a power connector. In some applications, the power connector includes a number of wafers that typically are about two millimeters in thickness. Power is transmitted through traces on the wafers.

The daughter board includes active components that use the power. Ideally, the power source would deliver its rated power at all times. However, when the power consuming devices include switching devices, invariably, the changing loads cause a fluctuation in the power output of the power source. In addition, the inductance of system components such as wires, traces, and connectors, etc. make it more difficult to avoid localized power plane voltage fluctuations. In particular, inductance within the power connector itself is sought to be reduced.

When chips or components on the daughter board switch rapidly, there is a need for a mechanism that can maintain the power supply voltage to the daughter board. Traditionally, the problems associated with power source fluctuations have been addressed through the use of decoupling capacitors in an effort to prevent large voltage drops associated with component switching. If the voltage drops below a required range, the switching of the components is affected such that the components do not function properly. The capacitors are placed on the backplane near the power connectors so that when rapid switching occurs, the capacitors store some of the energy, after which the stored energy can be drawn from the capacitor and made available to the system in an effort to maintain system voltages. Capacitors are also used on the daughter board to smooth out power fluctuations.

Generally, the decoupling capacitors are more effective when they are in close proximity to the power connectors. The decoupling capacitors could be placed inside the power connector; however this increases the size and complexity of the connector. It would be desirable to be able to move the decoupling effect into the power connector without the use of additional components that increase the size and complexity of the power connector.

BRIEF DESCRIPTION OF THE INVENTION

In one aspect of the invention, a power connector is provided. The power connector includes a housing and an electrical wafer mounted in the housing. The wafer includes a dielectric material having a thickness between a first side and a second side. The second side is opposite the first side and substantially parallel to the first side. A power trace is located on the first side of the wafer. A ground trace is located on the second side of the wafer. The power trace at least partially overlaps the ground trace. The thickness is such that the power trace and the ground trace form a decoupling capacitor that reduces fluctuations in the power transmitted through the connector.

Optionally, the wafer includes a first contact edge and a second contact edge that intersects the first contact edge. The first side of the wafer includes a ground trace and a plurality of vias connecting the ground trace on the first side to the ground trace on the second side. The wafer is configured to have connections made to only one of the first and second sides. The dielectric material and the thickness are selected so that a ratio of a dielectric constant for the dielectric material to the thickness is about four hundred or greater.

In another aspect, a power connector is provided that includes a housing and an electrical wafer mounted in the housing. The wafer includes a dielectric material having a substantially uniform thickness between a first side and a second side. The second side is opposite the first side and substantially parallel to the first side. An energy storage device is integrally formed with the wafer. The connector stores and releases energy in response to fluctuations in power being transmitted through the connector to reduce the fluctuations in the power transmitted through the connector.

In yet another aspect, a wafer for a power connector is provided. The wafer includes a dielectric material having a thickness between a first side and a second side. The second side is opposite the first side and substantially parallel to the first side. A power trace is located on the first side of the wafer and a ground trace is located on the second side of the wafer. The power trace at least partially overlaps the ground trace. The dielectric material and the thickness are selected so that a ratio of a dielectric constant for the dielectric material to the thickness is about four hundred or greater. The thickness is such that the power trace and the ground trace form a decoupling capacitor that reduces fluctuations in the power transmitted through the connector.

DETAILED DESCRIPTION OF THE INVENTION

Figure 1:
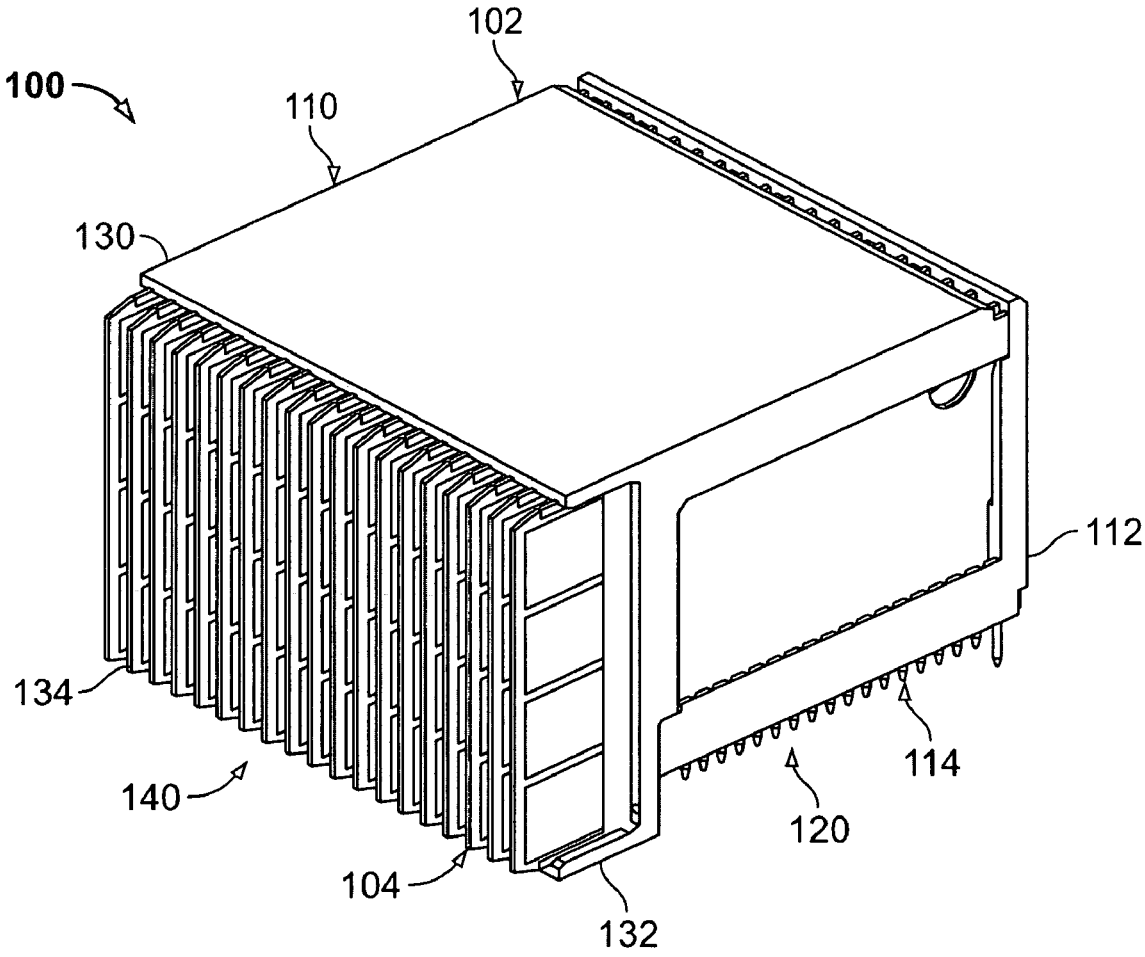
FIG. 1 is a perspective view of a power connector formed in accordance with an exemplary embodiment of the present invention.

FIG. 1 illustrates a power connector 100 formed in accordance with an exemplary embodiment of the present invention. The connector 100 is configured to reduce fluctuations in power transmitted through the connector 100. The connector 100 exhibits some of the characteristics of a capacitor while using only materials and components necessary to transmit power through the connector 100. The connector 100 will be described in terms of a right angle connector, however, it is to be understood that this is for purposes of illustration only and no limitation is intended thereby. In alternative embodiments, other configurations may be employed.

The connector 100 includes a housing 102 and a plurality of electrical wafers 104. The housing 102 includes a cover portion 110 and a base portion 112. The base 112 includes a plurality of contacts 114 that form a daughter card or daughter board interface 120. The contacts 114 have a resilient upper end 122 (FIG. 2) that receives an edge of the wafer 104. The cover 110 includes an upper shroud 130 and a lower shroud 132 that partially cover a mating end of the connector 100. Each of the wafers 104 includes a backplane edge 134 and these edges combine to form a backplane connector interface 140.

Figure 2:
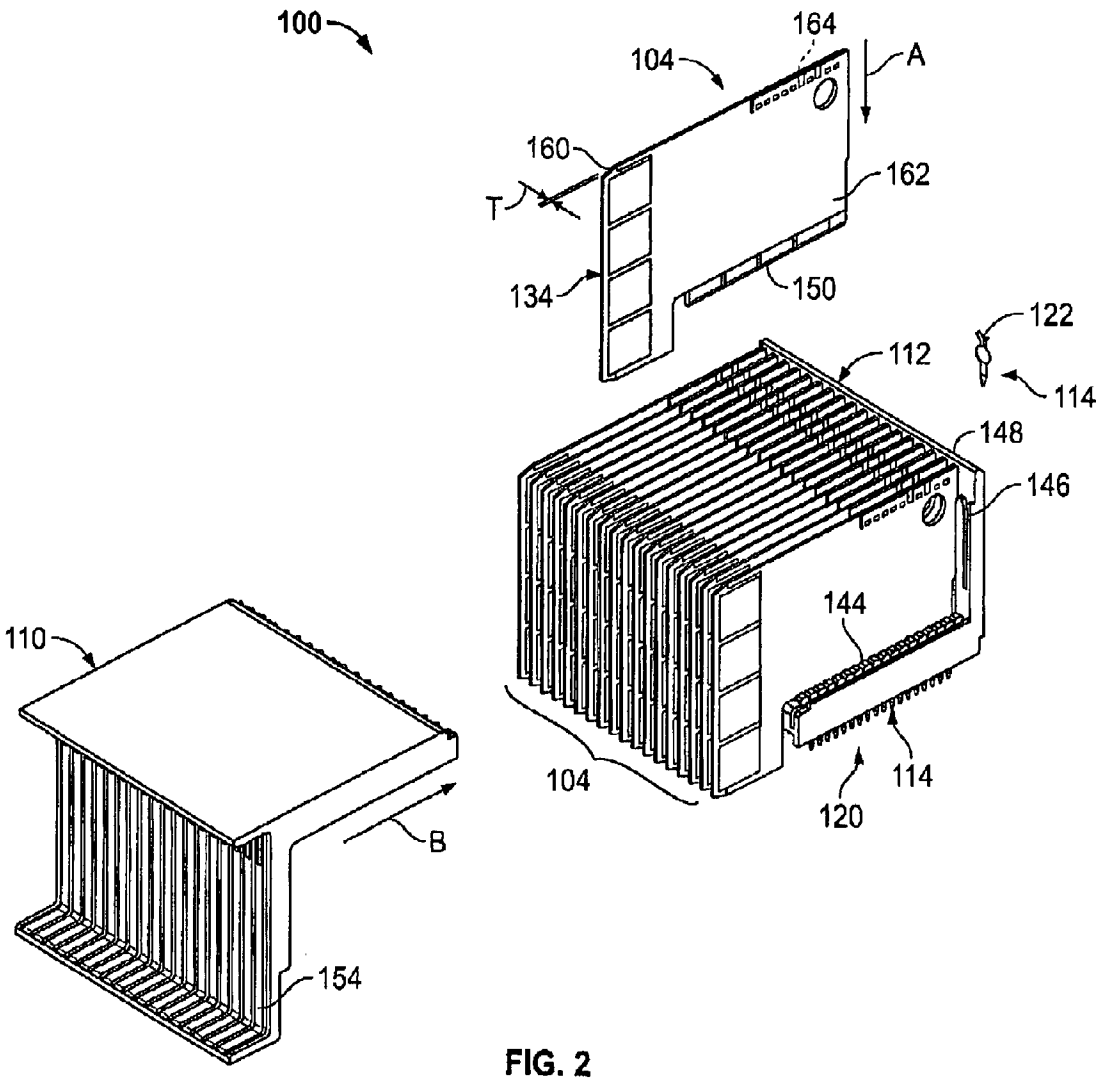
FIG. 2 is an exploded view of the connector of FIG. 1.

FIG. 2 illustrates an exploded view of the connector 100. The housing base 112 includes a plurality of slots 144. The wafers 104 are received into the slots 144 with a card edge connection. An alignment slot 146 is formed into the back wall 148 of the housing base 112 at each slot 144. Each wafer 104 includes a daughter card or daughter board edge 150 that is received in the upper end 122 of the contacts 114. The contacts 114 extend through the housing base 112 to become part of the daughter board interface 120. The wafers 104 are inserted into the slots 144 in a downward direction indicated by the arrow A. The housing cover 110 includes a plurality of alignment apertures 154 that receive the backplane edges 134 of the wafers 104. The apertures 154 hold and stabilize the wafers 104 in the slots 144 of the housing base 112. After the wafers 104 are installed in the housing base 112, the housing cover 110 is attached by sliding the cover 110 onto the base 112 in the direction of arrow B so that the backplane edges 134 of the wafers 104 extend through the apertures 154.

Each wafer 104 includes a planar sheet of a dielectric material 160 that has a first side 162 and a second side 164 that is opposite and substantially parallel to the first side 162. In one embodiment, the wafer 104 is a printed circuit board and the dielectric material 160 is a material such as FR4. The dielectric material 160 has a thickness T that is substantially uniform between the first and second sides 162 and 164, respectively. In an exemplary embodiment, the dielectric material is a printed circuit board. In other embodiments, any insulating material having a sufficiently high dielectric constant may be used. In one embodiment, the backplane edge 134 and the daughter board edge 150 are substantially perpendicular to each other. However, in alternative embodiments, it is contemplated that edges 134 and 150 may intersect at other than a right angle, or the edges 134 and 150 may be parallel.

Figure 3:
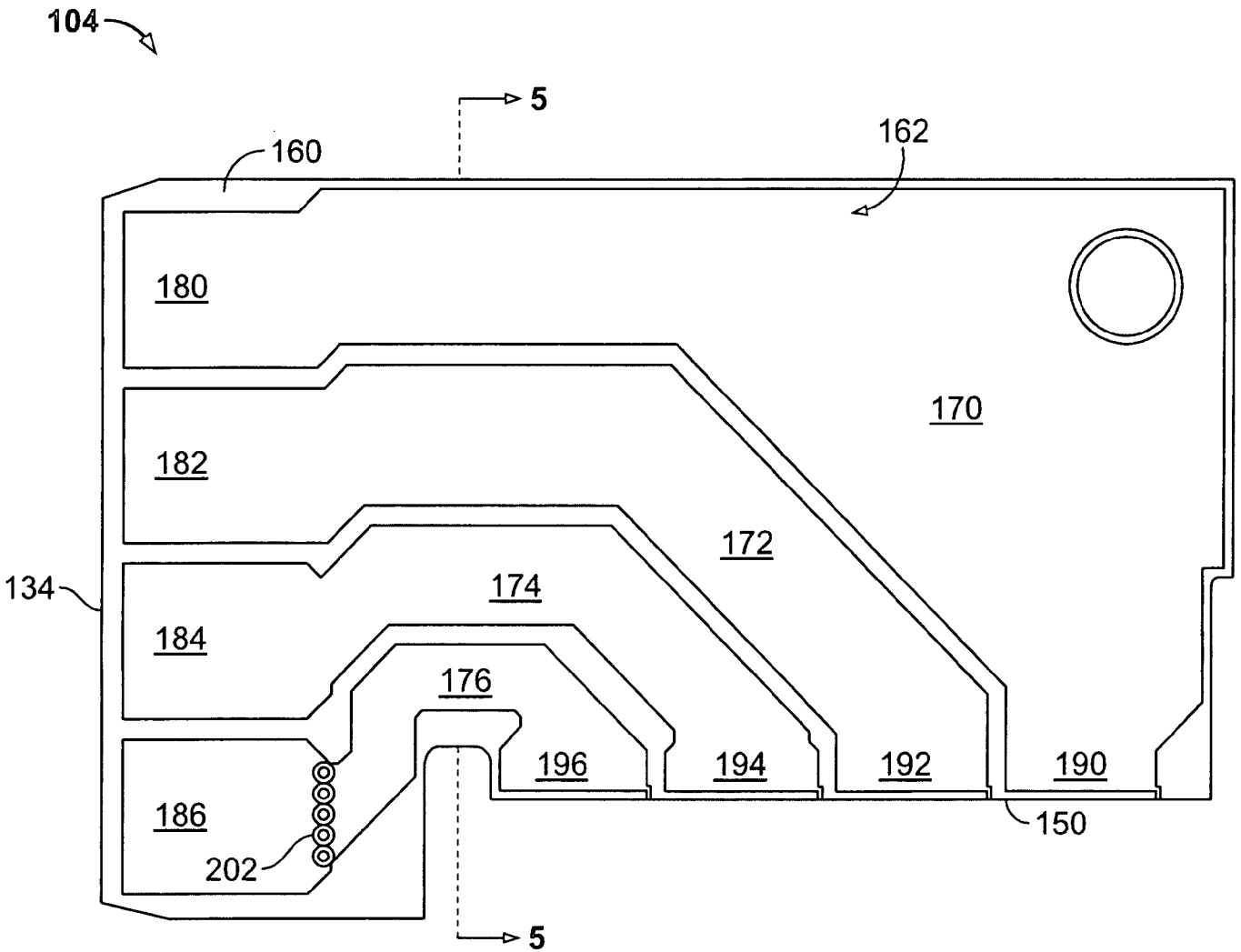
FIG. 3 is a side elevation view of the first side of an exemplary wafer formed in accordance with an exemplary embodiment of the present invention.
Figure 4:
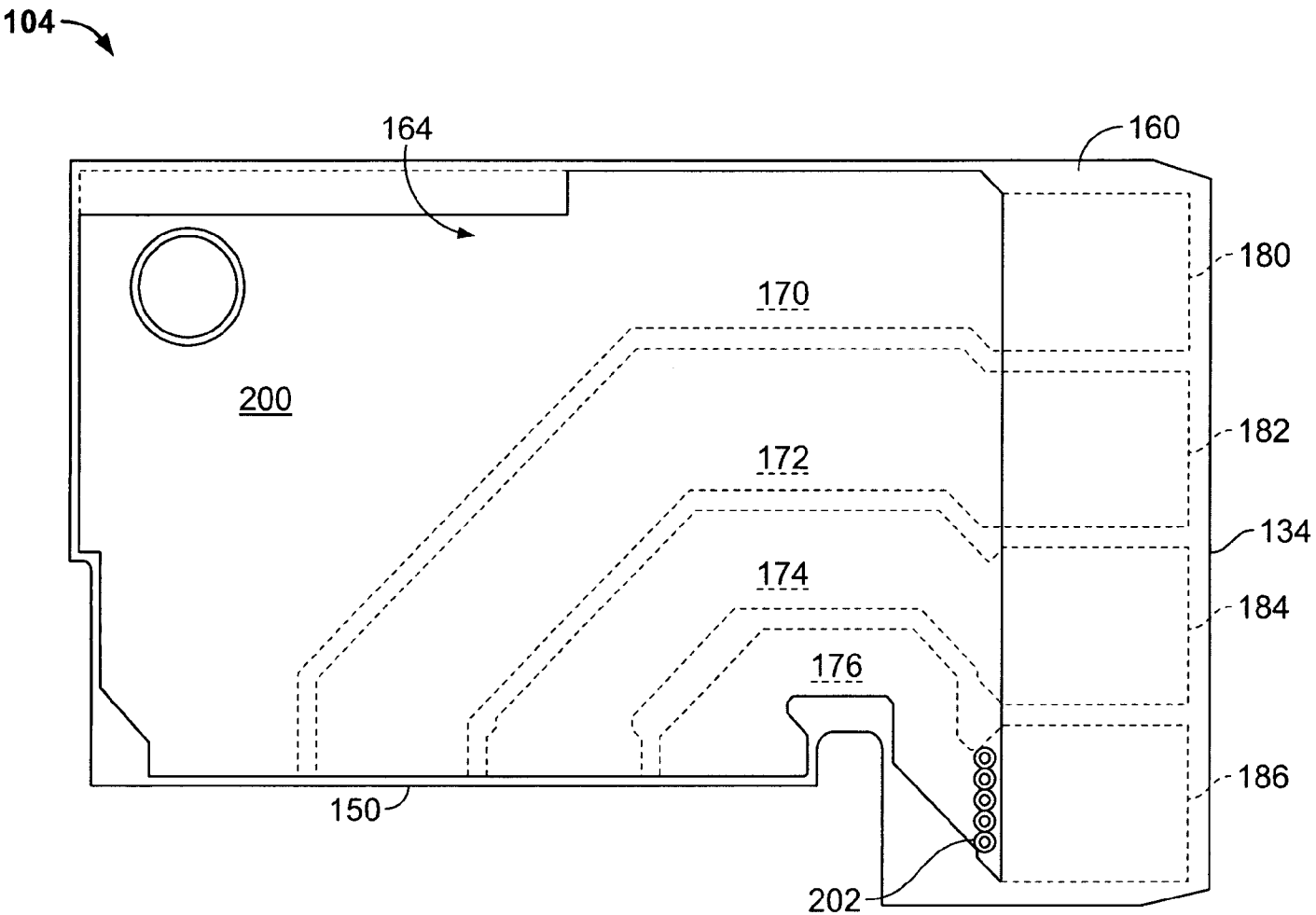
FIG. 4 is a side elevation view of the second side of the wafer shown in FIG. 3.

FIG. 3 illustrates a side elevation view of the first side 162 of the wafer 104. FIG. 4 illustrates a side elevation view of the second side 164 of the wafer 104. The first side 162 includes a number of power traces 170, 172, 174, and a ground trace 176. The traces 170, 172, 174, and 176 extend between power contact pads 180, 182, 184, and a ground contact pad 186 arranged along the backplane edge 134, and power contact pads 190, 192, 194, and a ground contact pad 196 arranged along the daughter board edge 150. The ends 122 of contacts 114 (FIG. 2) engage the contact pads 190, 192, 194, and 196 along the daughter board edge 150 to connect each wafer to the daughter board interface 120. In the embodiment shown in FIG. 3, three power traces are present. It is to be understood however, that in other embodiments a fewer or greater number of power traces may be present.

The second side 164 includes a single ground trace or ground plane 200. The power traces 170, 172, 174 and the ground trace 176 on the first side 162 are shown in phantom outline. Vias 202 extend through the dielectric material 160 to connect the ground plane 200 to the ground trace 176 on the first side 162 of the wafer 104. The ground trace 200 is substantially parallel to the power traces 170, 172, and 174 on the first side 162 of the wafer 104. The second side 164 is without contact pads at the backplane edge 134. The wafer 104 as depicted in FIGS. 3 and 4 exemplifies an embodiment wherein contacts are provided that make connections only with the first side 162, of the wafer 104. In such applications, a ground trace 176 is provided on the first side 162 to make the ground reference available to the backplane and daughter board.

The power traces 170, 172, 174 at least partially overlap the ground trace 200. That is, at least a portion of the surface area of each power trace 170, 172, and 174 on the first side 162 of the wafer 104 coincides with a portion of the surface area of the ground trace 200 on the second side 164 in a direction substantially perpendicular to the surfaces of the first and second sides 162 and 164 respectively.

The connector 100 provides decoupling with a low inductance power—ground couple inside the connector, using only the materials used for power transmission through the connector 100. When switching of power consuming components occurs, the connector 100 acts as a capacitor that stores and releases energy to reduce voltage fluctuations in the power transmitted through the connector 100. The characteristics of a capacitor are achieved by the placement of the power traces 170, 172, and 174 on one side 162 and the ground trace 200 on the opposite side 164 of the wafer 104, and separating the power and ground traces by the dielectric material 160. Effectively, each wafer 104 is provided with an energy storage device integrally formed therewith. The dielectric material 160 and the thickness T are selected to provide a usable charge storage capability in the connector 100. The dielectric material 160 and the thickness T are selected such that the ratio of the dielectric constant for the dielectric material 160 to the thickness T is about four hundred or greater. In an exemplary embodiment, the dielectric material 160 is comprised of a PCB material having a dielectric constant of about four, and formed with a thickness T of about 0.01 (ten thousandths) inch.

Each power trace 170, 172, and 174 forms a decoupling capacitor within the connector 100. The total capacitance of the connector 100 is the sum of the capacitance of the individual power traces 170, 172, and 174. The capacitance of each power trace 170, 172, 174 is determined by the equation:

$$C=(A/D)*\in$$

where: C is the capacitance, A is the surface area of the power trace, D is the thickness of the dielectric material, and $\in$ is the dielectric constant of the dielectric material.

Figure 5:
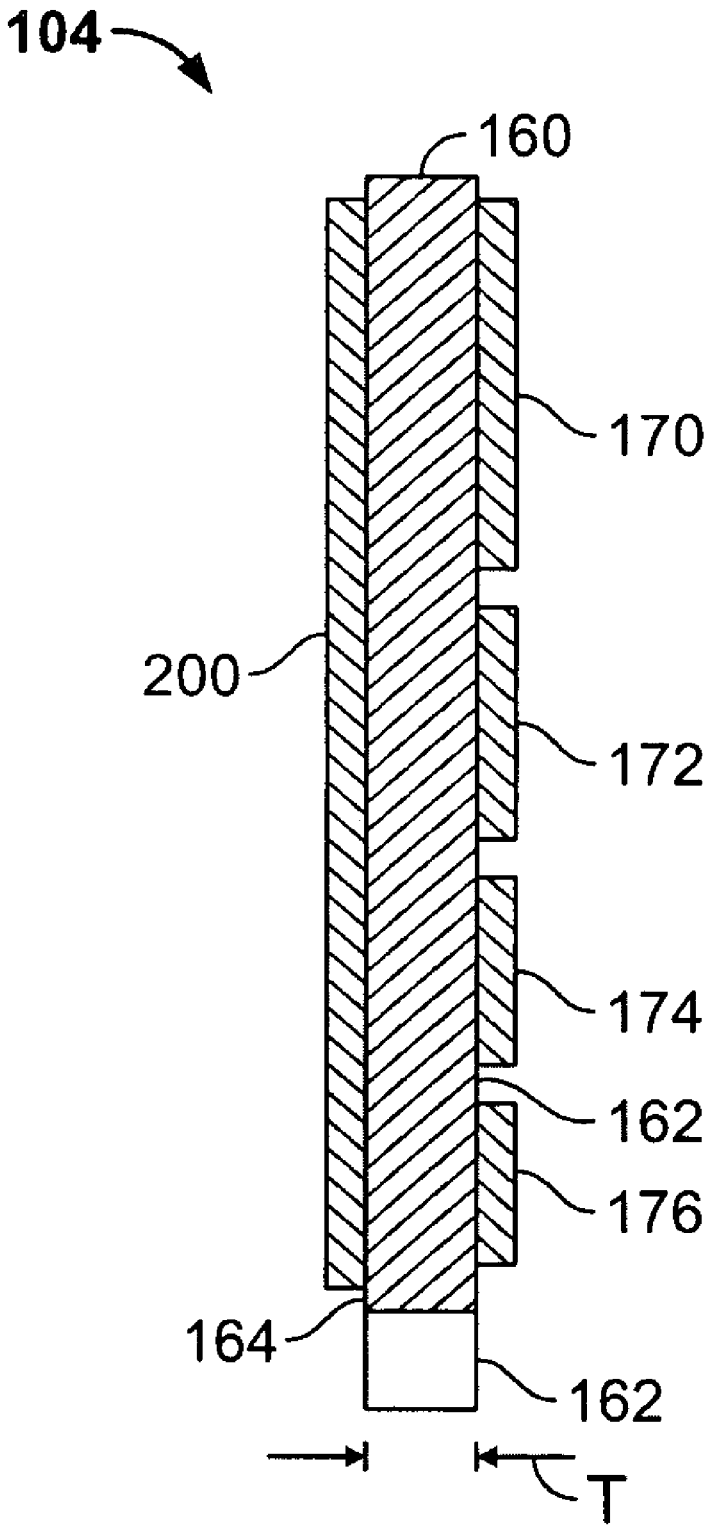
FIG. 5 is a cross sectional view of the wafer taken along line 5—5 in FIG. 3.

FIG. 5 illustrates a cross section of the wafer 104 taken along the line 5—5 shown in FIG. 3. The dielectric material 160 has a thickness T and separates the power traces 170, 172, 174 and the ground trace 200. The ground trace 176 on the first side 162 of the dielectric material is connected to the ground trace 200 through the vias 202 (FIGS. 3 and 4) and thus the ground trace 176 is at the same electrical potential as the ground trace 200. The power traces 170, 172, 174 have a different electrical potential than the ground traces 200 and 176. The surface area A in the above equation represents the surface area of the power traces 170, 172, 174 that is parallel to the ground trace 200 and that overlaps the ground trace 200. The performance of the connector 100 is improved as capacitance increases. That is, as capacitance increases, so does the energy storage capacity of the connector 100.

As seen from the equation above, a thinner dielectric layer and/or a dielectric material having a higher dielectric constant increases capacitance. For instance, the table below illustrates various dielectric thicknesses and dielectric constant combinations that yield a dielectric constant-to-thickness ratio of 400.

| Thickness | Dielectric Constant |
|---|---|
| .01 | 4 |
| .02 | 8 |
| .04 | 16 |
| .005 | 2 |

In operation, the storage and release of energy in the connector 100 occurs automatically in response to fluctuations in power being transmitted through the connector 100.

The embodiments thus described provide a power connector 100 that reduces fluctuations in power transmitted through the connector 100. The connector 100 exhibits some of the characteristics of a capacitor, but uses only materials and components necessary to transmit power through the connector 100. The connector 100 avoids the use of decoupling capacitors external to the connector 100 thereby saving space on the backplane and daughter boards. The connector 100 may be in the form of a right angle connector.

While the invention has been described in terms of various specific embodiments, those skilled in the art will recognize that the invention can be practiced with modification within the spirit and scope of the claims.

What is claimed is:

1. An electrical power connector comprising:

a housing;

an electrical wafer mounted in said housing, said wafer including a dielectric material having a thickness between a first side and a second side, said second side opposite said first side and substantially parallel to said first side;

a power trace located on said first side of said wafer; and a ground trace on said second side of said wafer, said power trace at least partially overlapping said ground trace;

wherein the thickness is such that said power trace and said ground trace form a decoupling capacitor that reduces fluctuations in the power transmitted through the connector and wherein said dielectric material and said thickness measured in inches are selected so that a ratio of a dielectric constant for said dielectric material to said thickness is about four hundred or greater.

2. The power connector of claim 1, wherein the thickness of the dielectric material is no greater than about 0.01 inch.

3. The power connector of claim 1, wherein said wafer further includes a first contact edge and a second contact edge that intersects said first contact edge.

4. The power connector of claim 1, wherein said first side includes a ground trace and a plurality of vias connecting said ground trace on said first side to said ground trace on said second side.

5. The power connector of claim 1, wherein said wafer is configured to have connections made to only one of said first and second sides.

6. The power connector of claim 1, wherein said housing comprises a base portion and a cover portion, said base portion including an alignment slot, said wafer having an edge receivable in said alignment slot, and said cover portion including an aperture configured to receive and stabilize said wafer.

7. The power connector of claim 1, wherein said wafer comprises a printed circuit board wafer.

8. The power connector of claim 1, wherein said base portion further includes a slot configured to receive one of said first and second contact edges with a card edge connection.

9. An electrical power connector comprising:

a housing;

an electrical wafer mounted in said housing, said wafer including a dielectric material having a thickness between a first side and a second side, said second side opposite said first side and substantially parallel to said first side; and an energy storage device integrally formed with said wafer, wherein said energy storage device comprises a power trace located on said first side of said wafer and a ground trace on said second side of said wafer;

wherein said energy storage device stores and releases energy in response to fluctuations in power transmitted through the connector to reduce the fluctuations in the power transmitted through the connector and wherein said dielectric material and said thickness measured in inches are selected so that a ratio of a dielectric constant for said dielectric material to said thickness is about four hundred or greater.

10. The power connector of claim 9, wherein said power trace at least partially overlaps said ground trace.

11. The power connector of claim 9, wherein the thickness of said dielectric material is no greater than about 0.01 inch.

12. The power connector of claim 9, wherein said wafer further includes a first contact edge and a second contact edge that intersects said first contact edge.

13. The power connector of claim 9, wherein said energy storage device further includes a ground trace on said first side and a plurality of vias connecting said ground trace on said first side to a ground trace on said second side.

14. The power connector of claim 9, wherein said wafer is configured to have connections made to only one of said first and second sides.

15. The power connector of claim 9, wherein said housing comprises a base portion and a cover portion, said base portion including an alignment slot, said wafer having an edge receivable in said alignment slot, and said cover portion including an aperture configured to receive and stabilize said wafer.

16. The power connector of claim 9, wherein said wafer comprises a printed circuit board wafer.

17. The power connector of claim 9, wherein said base portion further includes a slot configured to receive one of said first and second contact edges with a card edge connection.

18. An electrical wafer for an electrical power connector comprising:

a dielectric material having a thickness between a first side and a second side, said second side opposite said first side and substantially parallel to said first side;

a power trace located on said first side of said wafer; and a ground trace on said second side of said wafer, said power trace at least partially overlapping said ground trace;

wherein said dielectric material and said thickness measured in inches are selected so that a ratio of a dielectric constant for said dielectric material to said thickness is about four hundred or greater; and wherein the thickness is such that said power trace and said ground trace form a decoupling capacitor that reduces fluctuations in the power transmitted through the connector.

* * * * *